US007150161B2

(12) United States Patent
Huang

(10) Patent No.: US 7,150,161 B2
(45) Date of Patent: Dec. 19, 2006

(54) AIR CONDITIONER HAVING WATER DRAINING DEVICE

(76) Inventor: Chin Piao Huang, No. 40, Chisin Road, Baidon Li, Tonsiao Town, Miauli Hsien (TW) 357

( * ) Notice: Subject to any disclaimer, the term of this patent is extended or adjusted under 35 U.S.C. 154(b) by 69 days.

(21) Appl. No.: 10/890,744

(22) Filed: Jul. 13, 2004

(65) Prior Publication Data

US 2006/0010897 A1 Jan. 19, 2006

(51) Int. Cl.
*F25B 47/00* (2006.01)

(52) U.S. Cl. ..... 62/279; 62/305

(58) Field of Classification Search ..... 62/272, 62/280, 288, 279, 305
See application file for complete search history.

(56) References Cited

U.S. PATENT DOCUMENTS 4,135,370 A * 1/1979 Hosoda et al. ..... 62/274
5,467,615 A * 11/1995 Bolton et al. ..... 62/498
5,560,216 A * 10/1996 Holmes ..... 62/161
6,345,514 B1 * 2/2002 Moon et al. ..... 62/279
6,363,736 B1 * 4/2002 Kunkel et al. ..... 62/291
6,446,455 B1 * 9/2002 Sohn et al. ..... 62/298
6,477,854 B1 * 11/2002 Chung et al. ..... 62/280
6,755,037 B1 * 6/2004 Engel et al. ..... 62/177
2003/0041604 A1 * 3/2003 Jang ..... 62/171

* cited by examiner

*Primary Examiner*—Melvin Jones
(74) *Attorney, Agent, or Firm*—Charles E. Baxley

(57) ABSTRACT

An air conditioner includes an outdoor device coupled to an indoor device via a hose, and a water draining device coupled between the outdoor device and the indoor device, to force water that may be generated in the indoor device from the indoor device to the outdoor device, and to prevent the water from dropping from the indoor device. The water draining device includes a casing having a channel to slidably receive a piston which may pump the water from the indoor device to the outdoor device. The indoor device includes a tray disposed in a container to collect water. The outdoor device includes a fan device to blow and to dry the water.

12 Claims, 12 Drawing Sheets

AIR CONDITIONER HAVING WATER DRAINING DEVICE

BACKGROUND OF THE INVENTION

1. Field of the Invention

The present invention relates to an air conditioner, and more particularly to an air conditioner having a draining device for draining water from indoor device of the air conditioner.

2. Description of the Prior Art

Typical air conditioners comprise an outdoor device for being disposed outdoors, and for generating cooling air, and an indoor device coupled to the outdoor device, for receiving the cooling air, and for allowing the cooling air to flow or to blow into the family buildings.

Normally, when the cooling air flows or blows into the family buildings via the indoor device, condense water may be generated in the indoor device, and may drop into the family buildings.

However, till now, the indoor device is directly coupled to the outdoor device, and the typical air conditioners do not have any water draining devices provided to remove or to drain the water that may be generated in the indoor device, such that the condense water may still drop into the family buildings and may dirt various objects in the family buildings.

The present invention has arisen to mitigate and/or obviate the afore-described disadvantages of the conventional air conditioners.

SUMMARY OF THE INVENTION

The primary objective of the present invention is to provide an air conditioner including a draining device for draining or removing water from indoor devices and for preventing water from dropping into family buildings from the indoor devices.

In accordance with one aspect of the invention, there is provided an air conditioner comprising an indoor device, an outdoor device coupled to the indoor device via a hose, and a water draining device coupled between the outdoor device and the indoor device, to force water that may be generated in the indoor device from the indoor device to the outdoor device, and to prevent the water from dropping from the indoor device.

The water draining device includes a casing having an entrance and an exit formed therein, and coupled to the indoor device and the outdoor device respectively. The casing includes a channel formed therein and communicating with the entrance and the exit thereof respectively, and a piston slidably received in the channel of the casing, to pump the water from the indoor device to the outdoor device.

The water draining device includes a motor attached to the casing and coupled to the piston, to move the piston along the channel of the casing in reciprocating action. The water draining device includes a crank coupled to a spindle of the motor, and coupled to the piston, to move the piston along the channel of the casing in reciprocating action.

The piston includes an oblong hole formed therein, the crank includes a pole extended therefrom and slidably received in the oblong hole of the piston, to move the piston to slide along the channel of the casing in reciprocating action.

The indoor device includes a container, and a tray disposed in the container, to collect water, the tray includes an outlet for coupling to the water draining device via a tube. The indoor device includes a piping disposed in the container, and arranged above the tray, to allow the tray to collect the water from the piping.

The indoor device includes a hose coupled to the tube, and then coupled to the water draining device, and a controller disposed between the tube and the hose, to control the water to flow from the indoor device to the water draining device.

The outdoor device includes a receptacle having a bottom plate, and having an inlet port coupled to the water draining device, to receive the water from the water draining device. The outdoor device includes a fan device disposed in the receptacle, to blow and to dry the water.

The outdoor device includes a compressor and a heat exchanging device disposed in the receptacle and coupled together, and the fan device is directed toward the heat exchanging device, to blow the water toward the heat exchanging device, and to allow the water to be evaporated by the heat exchanging device.

The receptacle includes a recess formed in the bottom plate thereof, to receive and collect the water therein, the recess of the bottom plate is located below the fan device. The outdoor device includes a motor attached to the receptacle, and having a spindle to which the fan device is attached.

A filter device may further be provided and coupled between the water draining device and the indoor device. For example, the filter device includes a base having a mouth coupled to the water draining device, a cap attached onto the base and having another mouth coupled to the indoor device, and a filter member disposed between the base and the cap, to filter the water flowing from the indoor device to the water draining device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figures 1, 3:
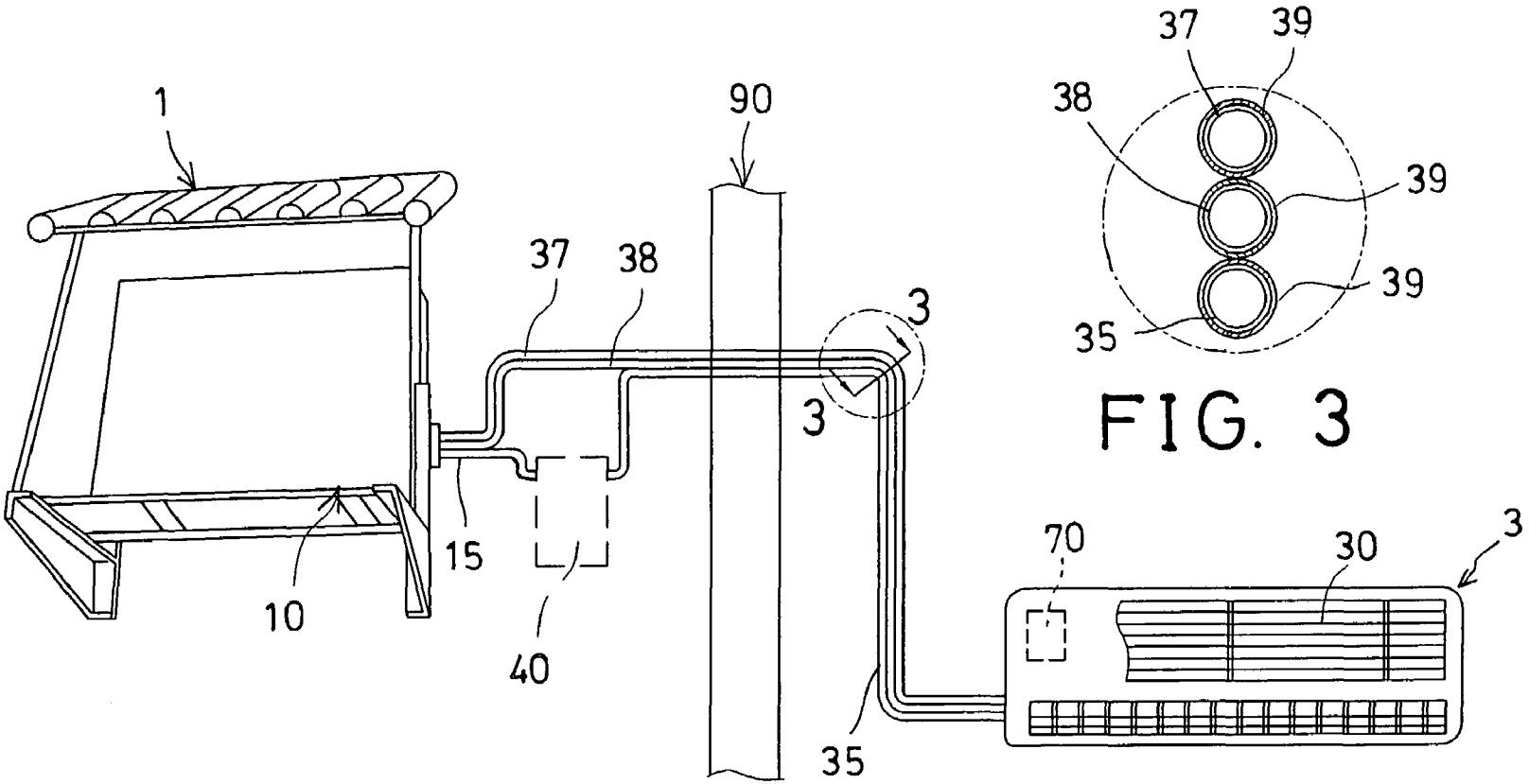
FIG. 1 is a perspective view of an air conditioner in accordance with the present invention.
FIG. 3 is a partial cross sectional view taken along lines 3—3 of FIG. 1.
Figure 2:
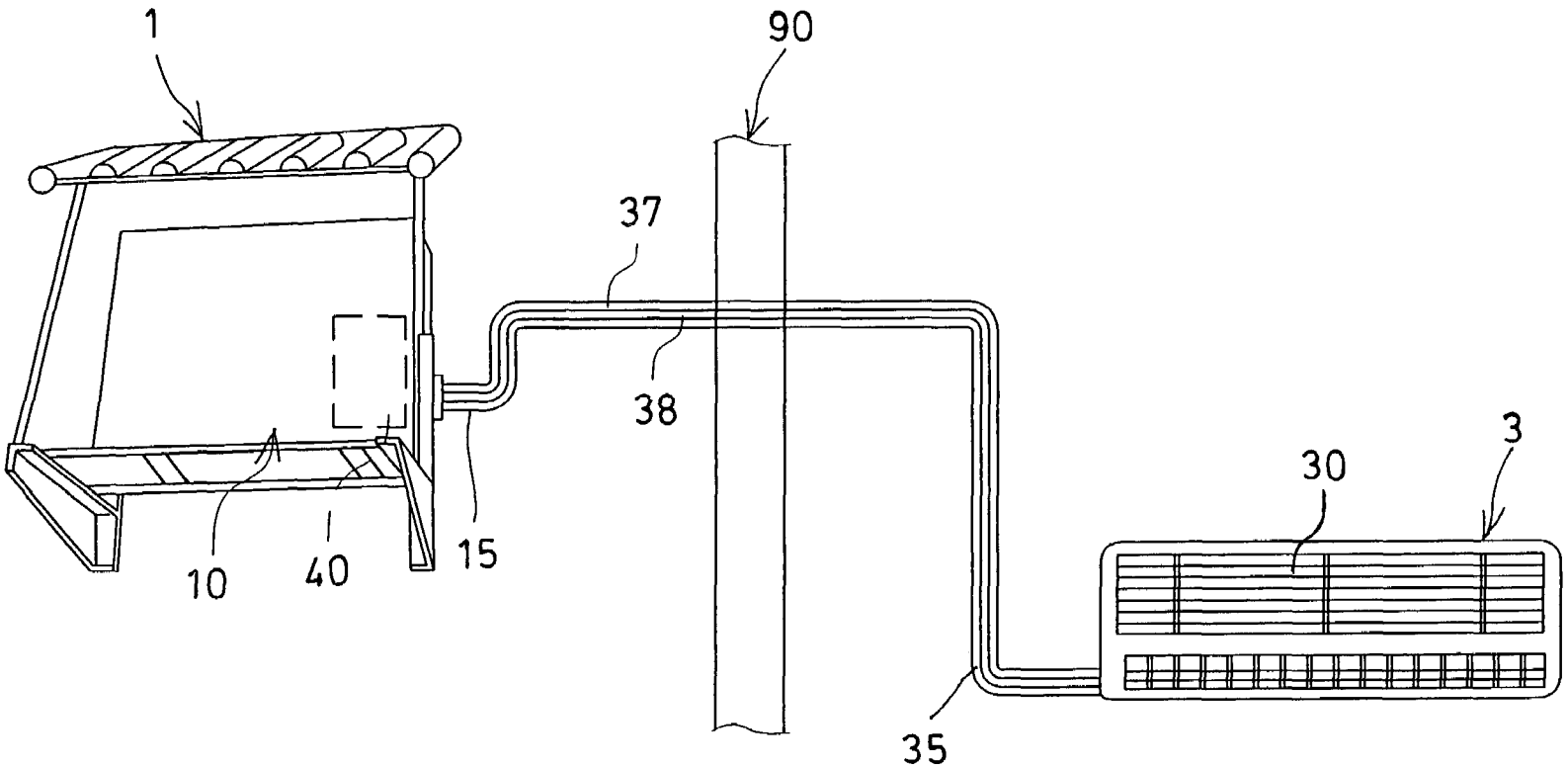
FIG. 2 is a perspective view similar to FIG. 1, illustrating the other arrangement of the air conditioner.

Referring to the drawings, and initially to FIGS. 1 and 2, an air conditioner in accordance with the present invention comprises an outdoor device 1 for being disposed outdoors, or for being disposed out of a wall 90 of family buildings, and for generating cooling air, and an indoor device 3 coupled to the outdoor device 1, for receiving the cooling air from the outdoor device 1, and for allowing the cooling air to flow or to blow into the family buildings.

Figure 4:
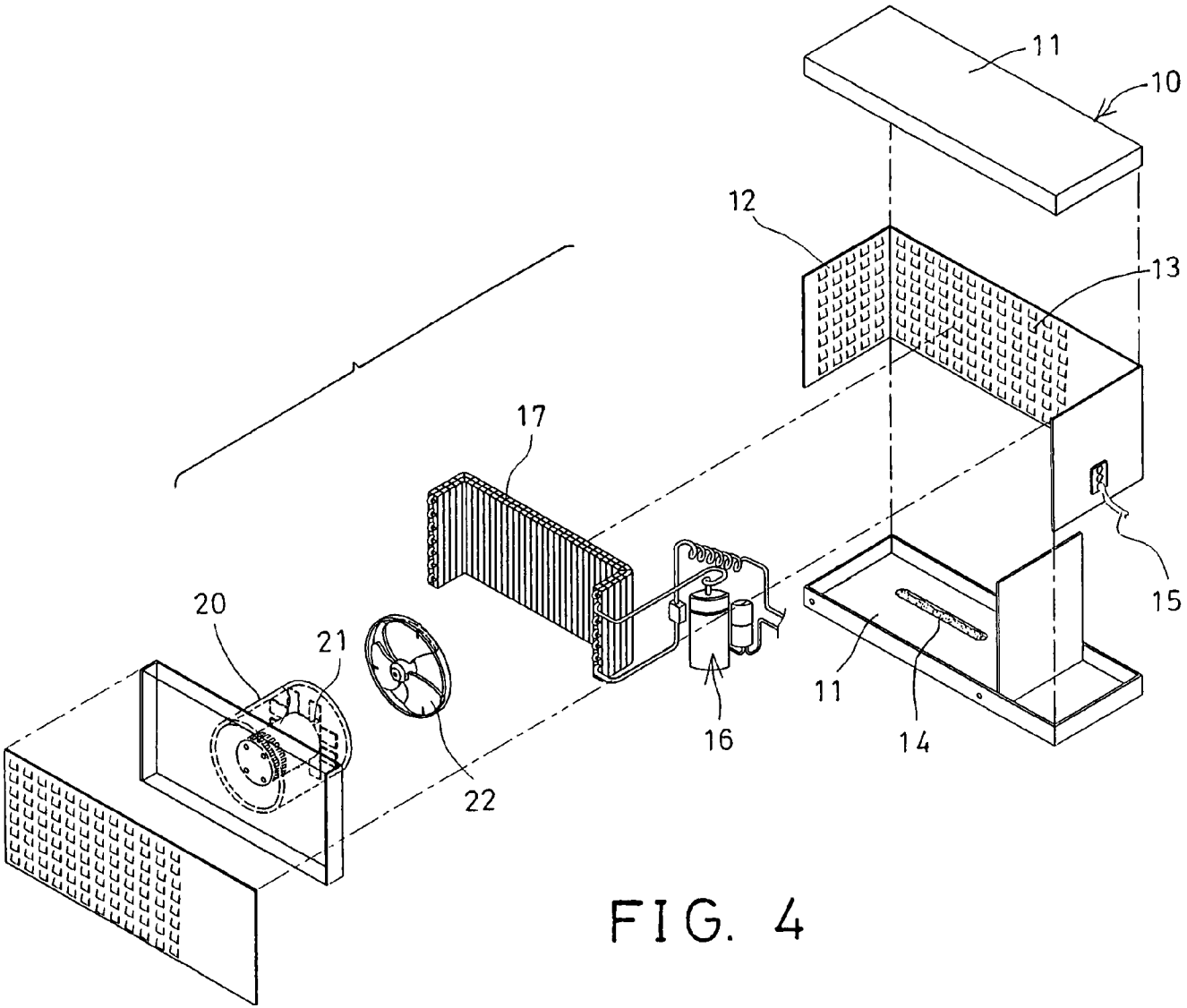
FIG. 4 is a partial exploded view of an outdoor device of the air conditioner.
Figure 6:
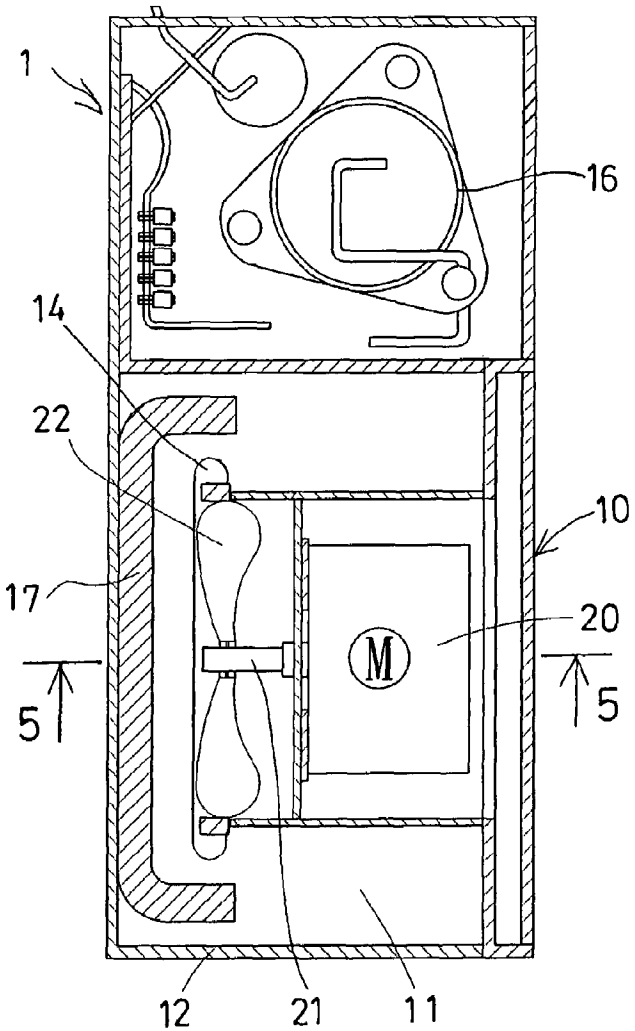
FIG. 6 is a partial cross sectional view taken along lines 6—6 of FIG. 5.
Figure 5:
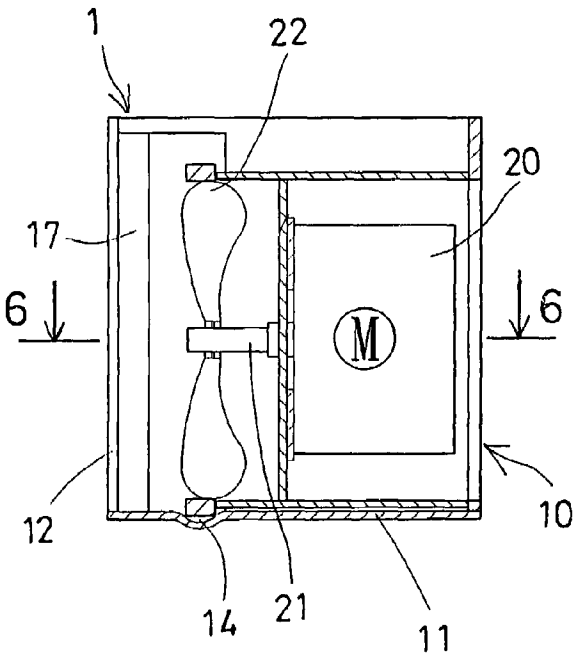
FIG. 5 is a partial cross sectional view taken along lines 5—5 of FIG. 6.

As shown in FIGS. 4–6, the outdoor device 1 includes a receptacle 10 having a peripheral fence 12 secured between a bottom and/or an upper plates 11, in which the peripheral fence 12 includes a number of perforations 13 formed therein, for allowing air to flow into and out of the receptacle 10. The bottom plate 11 includes a recess 14 formed therein (FIGS. 4, 5) for receiving water therein.

The receptacle 10 includes an inlet port 15 formed or provided therein (FIG. 4), such as formed in the peripheral fence 12, for receiving water or for allowing water to flow into the recess 14 of the bottom plate 11 of the receptacle 10. A compressor 16 is disposed in the receptacle 10 (FIGS. 4, 6), and includes a typical heater or evaporator or heat exchanging device 17 coupler thereto for heat exchanging purposes.

A motor 20 is attached or secured in the receptacle 10, and includes a spindle 21 to which a fan device 22 is attached. The fan device 22 may be used to blow or to dry the water. It is preferable that the fan device 22 is disposed or located above the recess 14 of the bottom plate 11 of the receptacle 10, for agitating or for blowing the water out of the recess 14 of the bottom plate 11, and for blowing the water toward the heat exchanging device 17, and thus for allowing the water to be heated or evaporated by the heat exchanging device 17.

Figure 7:
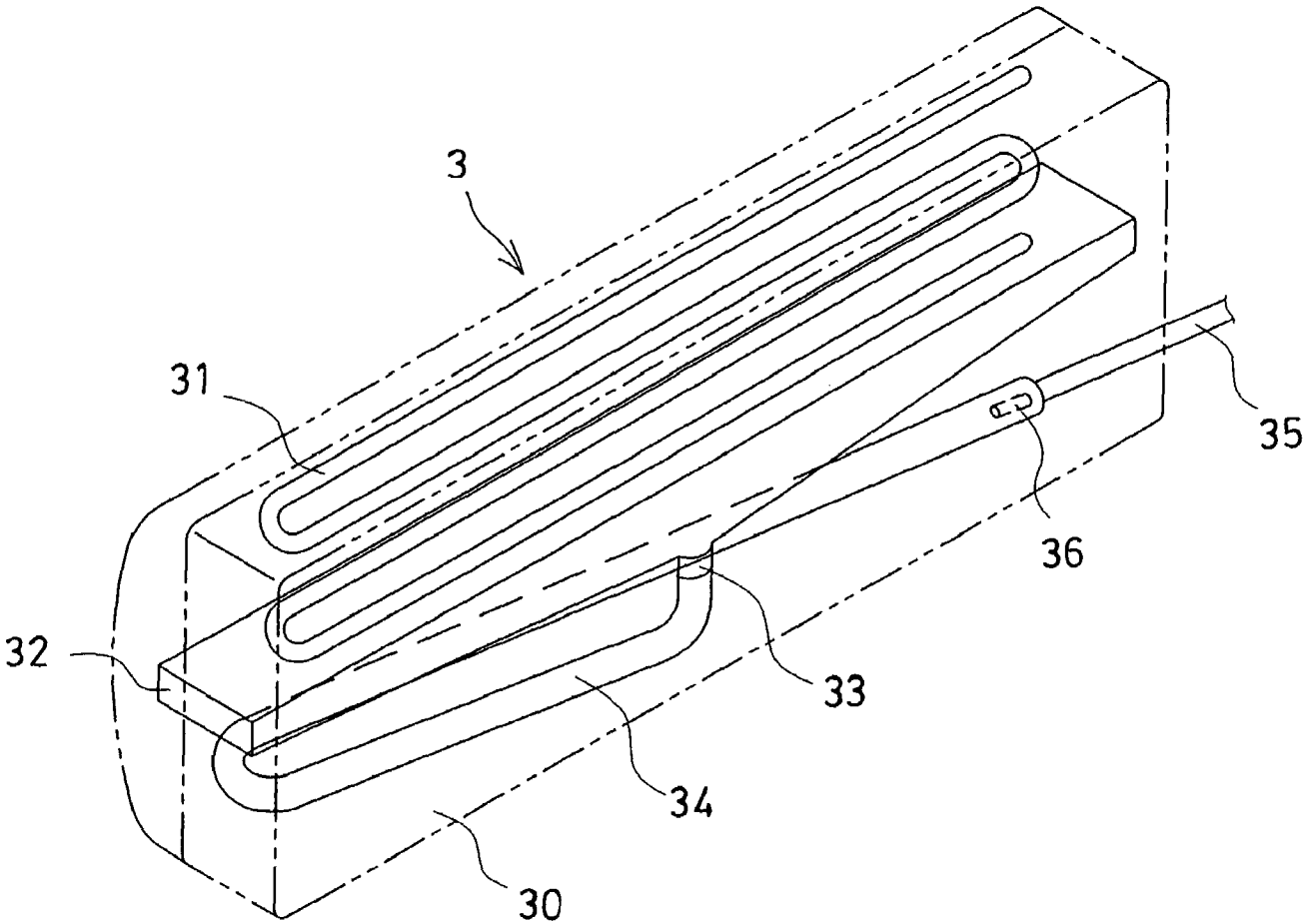
FIG. 7 is a partial perspective view of an indoor device of the air conditioner.
Figure 9:
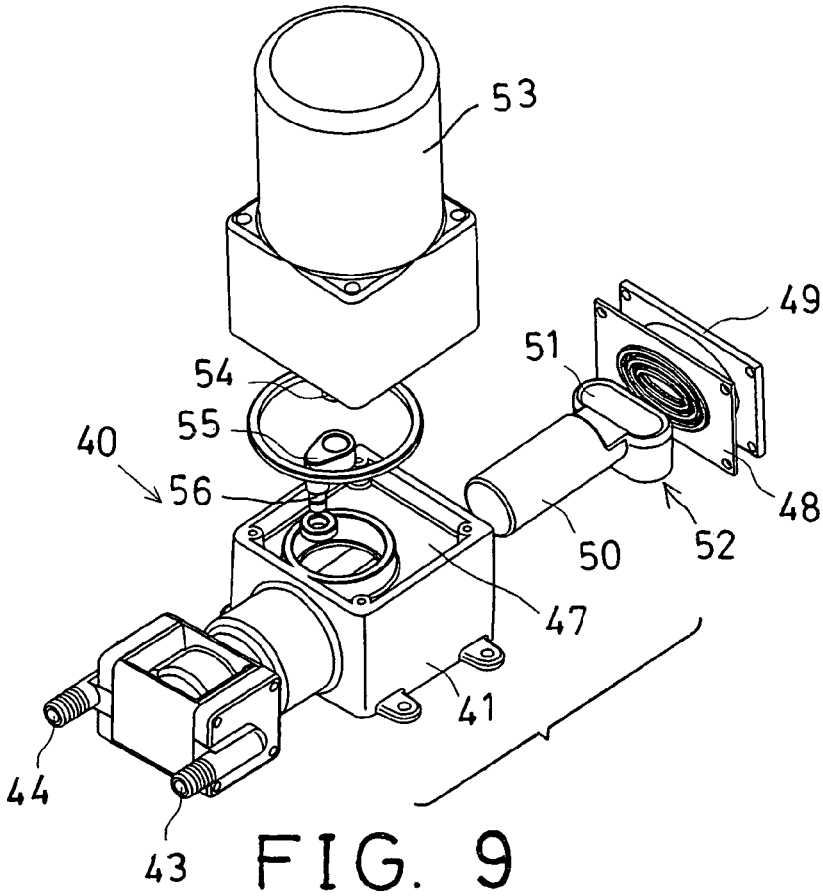
FIG. 9 is a partial exploded view of the water draining device of the air conditioner.
Figure 8:
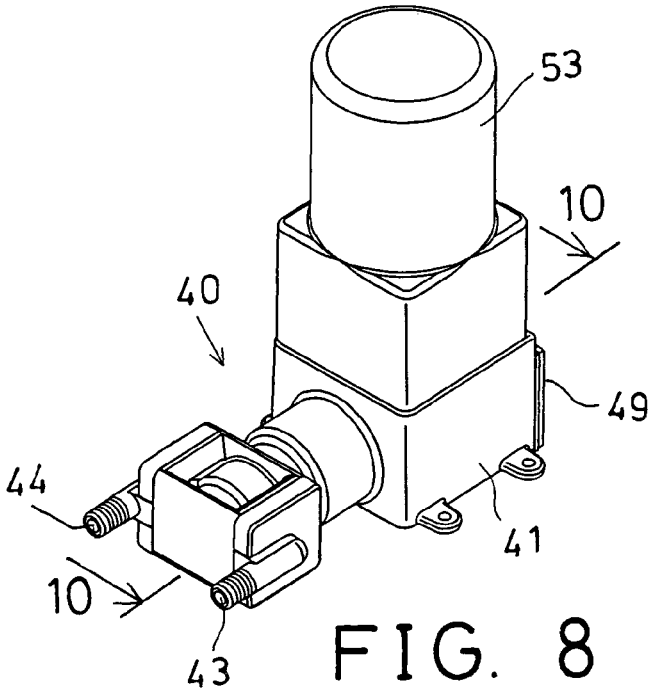
FIG. 8 is a partial perspective view of a water draining device of the air conditioner.

Referring next to FIG. 7, illustrated is an indoor device 3 which includes a container 30, a piping 31 received or disposed in upper portion of the container 30 for such as evaporating purposes, a tray 32 disposed in intermediate portion of the container 30, and arranged below the piping 31, for collecting water that may be dropped from the piping 31. The tray 32 includes an outlet 33 formed in bottom thereof for coupling to a tube 34.

A hose 35 may further be provided and coupled to the tube 34, and coupled to the inlet port 15 of the receptacle 10 (FIGS. 1, 2, 12, 15), for receiving the water that may be generated in the indoor device 3 and that may be collected in the tray 32 from the piping 31, and thus for allowing the water to flow into the receptacle 10, and to flow into the recess 14 of the bottom plate 11. A sensor or a controller 36 may be disposed in the tube 34 or the hose 35, or between the tube 34 and the hose 35, to control the water to flow to the receptacle 10 through the hose 35.

The air conditioner may further include two hoses 37, 38 coupled between the outdoor device 1 and the indoor device 3, such as coupled between the compressor 16 of the outdoor device 1 and the piping 31 of the indoor device 3, for allowing coolant or the like to flow between the outdoor device 1 and the indoor device 3. As best shown in FIG. 3, the hoses 35, 37, 38 may each include a heat insulating outer layer 39 attached thereon, for preventing heat loss or heat exchanging through the hoses 35, 37, 38.

Referring next to FIGS. 8–11 and again to FIGS. 1 and 2, illustrated is a water draining device 40 which may be coupled between the outdoor device 1 and the indoor device 3, or coupled between the hose 35 and the inlet port 15 of the receptacle 10, for forcing or pumping the water from the indoor device 3 into the receptacle 10 of the outdoor device 1. The water draining device 40 may also be selectively disposed within the receptacle 10 of the outdoor device 1 (FIG. 2).

The water draining device 40 includes a casing 41 having a channel 42 formed therein to slidably receive a valve or piston 50 therein, and having an entrance 43 and an exit 44 formed therein and communicating with the channel 42 thereof, for coupling to the indoor device 3 and the outdoor device 1 via the hose 35 and the inlet port 15 of the receptacle 10 respectively, and thus for allowing the water to be forced or pumped from the indoor device 3 into the receptacle 10 of the outdoor device 1 by the water draining device 40.

The water draining device 40 further includes two check valves 45, 46 disposed in the entrance 43 and the exit 44 of the casing 41 respectively, or disposed between the channel 42 and the entrance 43 and the exit 44 of the casing 41 respectively, to control or to limit the water to flow from the entrance 43 to the channel 42 and the exit 44 of the casing 41 only, and to prevent the water from flowing backward from the exit 44 of the casing 41 to the channel 42 and the entrance 43 of the casing 41.

The casing 41 includes a compartment 47 formed therein and communicating with the channel 42 thereof, and a seal 48 and/or a cover 49 detachably attached thereto, to selectively enclose the compartment 47 thereof. The piston 50 includes an oblong hole 51 laterally formed therein, and formed in one end 52 thereof which is slidably received in the compartment 47 of the casing 41.

A motor 53 is secured or attached onto the casing 41, and includes a spindle 54 having a crank 55 attached or secured thereto. The crank 55 includes a pole 56 extended therefrom and rotatably or slidably received in the oblong hole 51 of the piston 50, in order to move or to force the piston 50 to slide along the channel 42 of the casing 41 in reciprocating action, and thus to draw or to force or to pump the water from the indoor device 3 into the receptacle 10 of the outdoor device 1 via the entrance 43 and the exit 44 of the casing 41.

Figure 12:
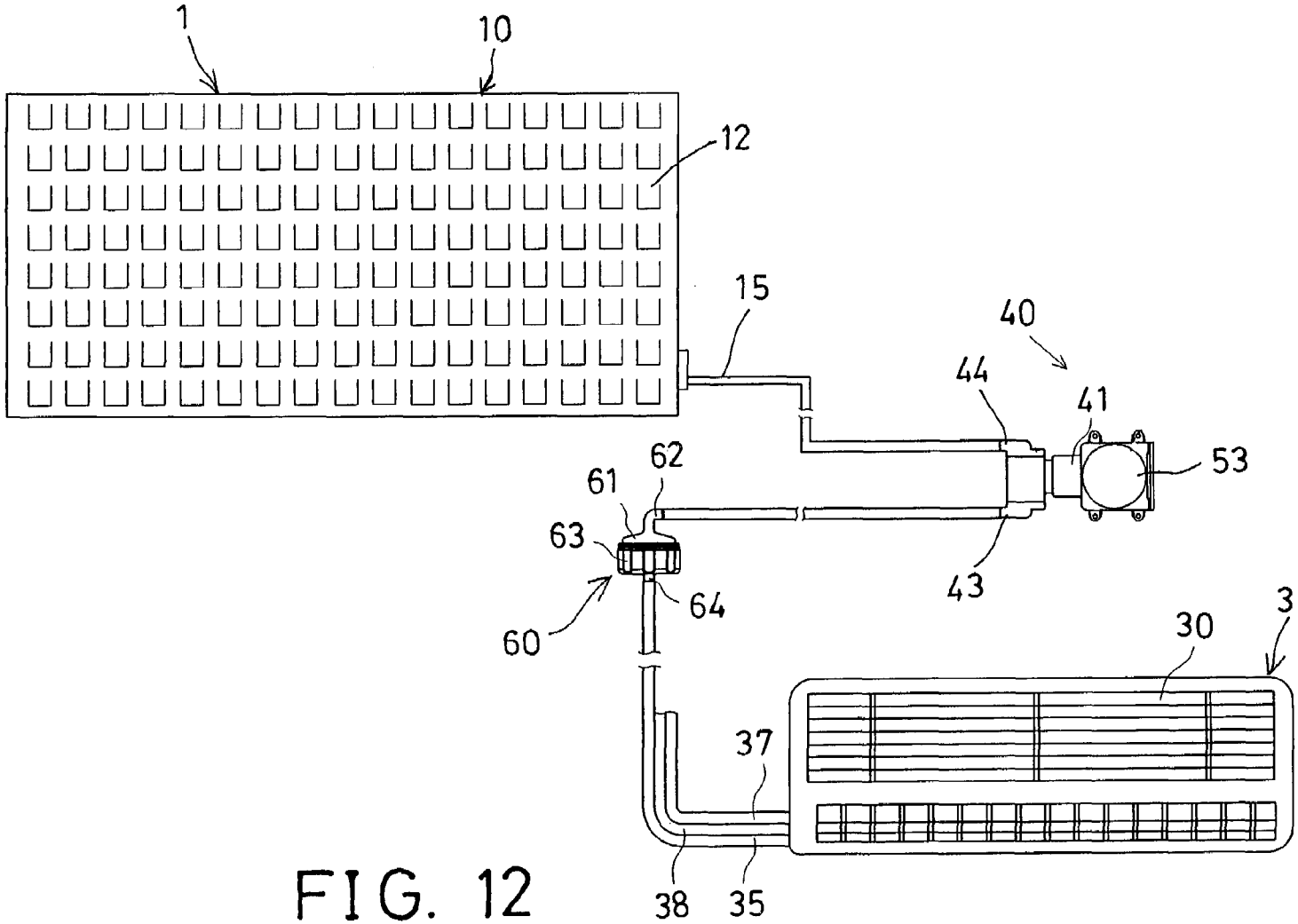
FIG. 12 is a plan schematic view illustrating the further arrangement of the air conditioner.
Figure 14:
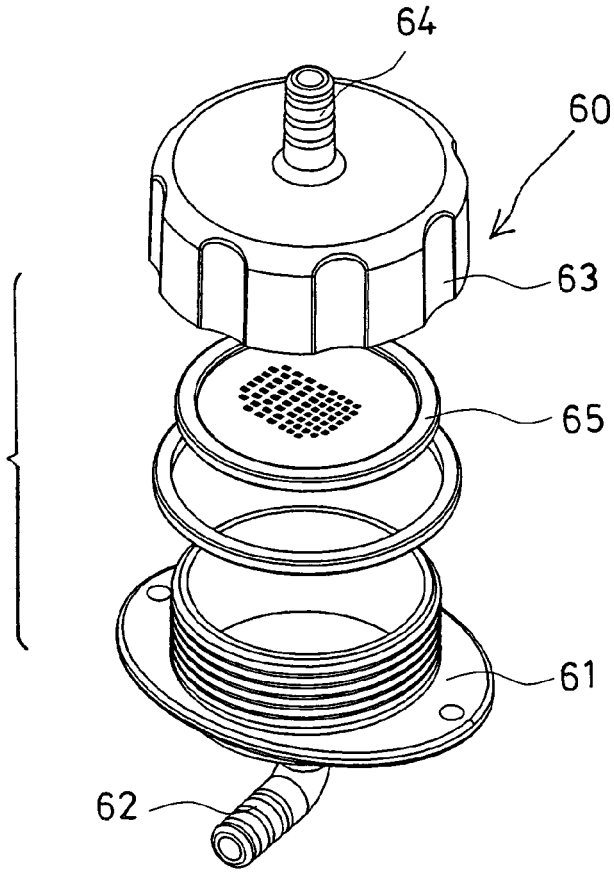
FIG. 14 is an exploded view of the water filtering device of the air conditioner.
Figure 13:
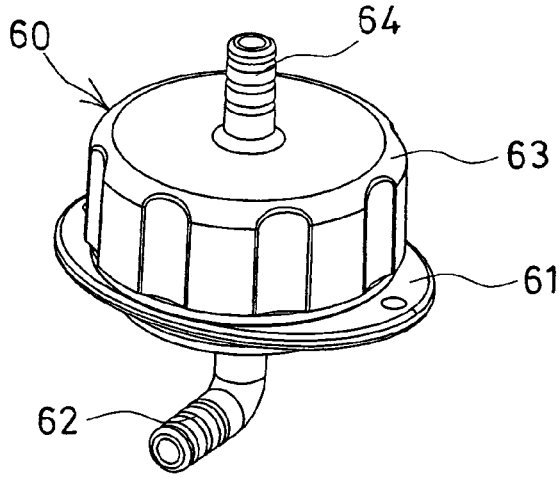
FIG. 13 is a perspective view of a water filtering device of the air conditioner.

Referring next to FIGS. 12–14, illustrated is a filter device 60 to be coupled to the hoses 35, or to be coupled between the water draining device 40 and the indoor device 3. The filter device 60 includes a base 61 having a mouth 62 coupled to the entrance 43 of the casing 41, a cap 63 threaded or attached onto the base 61 and having another mouth 64 coupled to the indoor device 3, and a filter member 65 (FIG. 14) disposed within or between the base 61 and the cap 63, for filtering the water flowing from the indoor device 3 into the receptacle 10 of the outdoor device 1.

Figure 15:
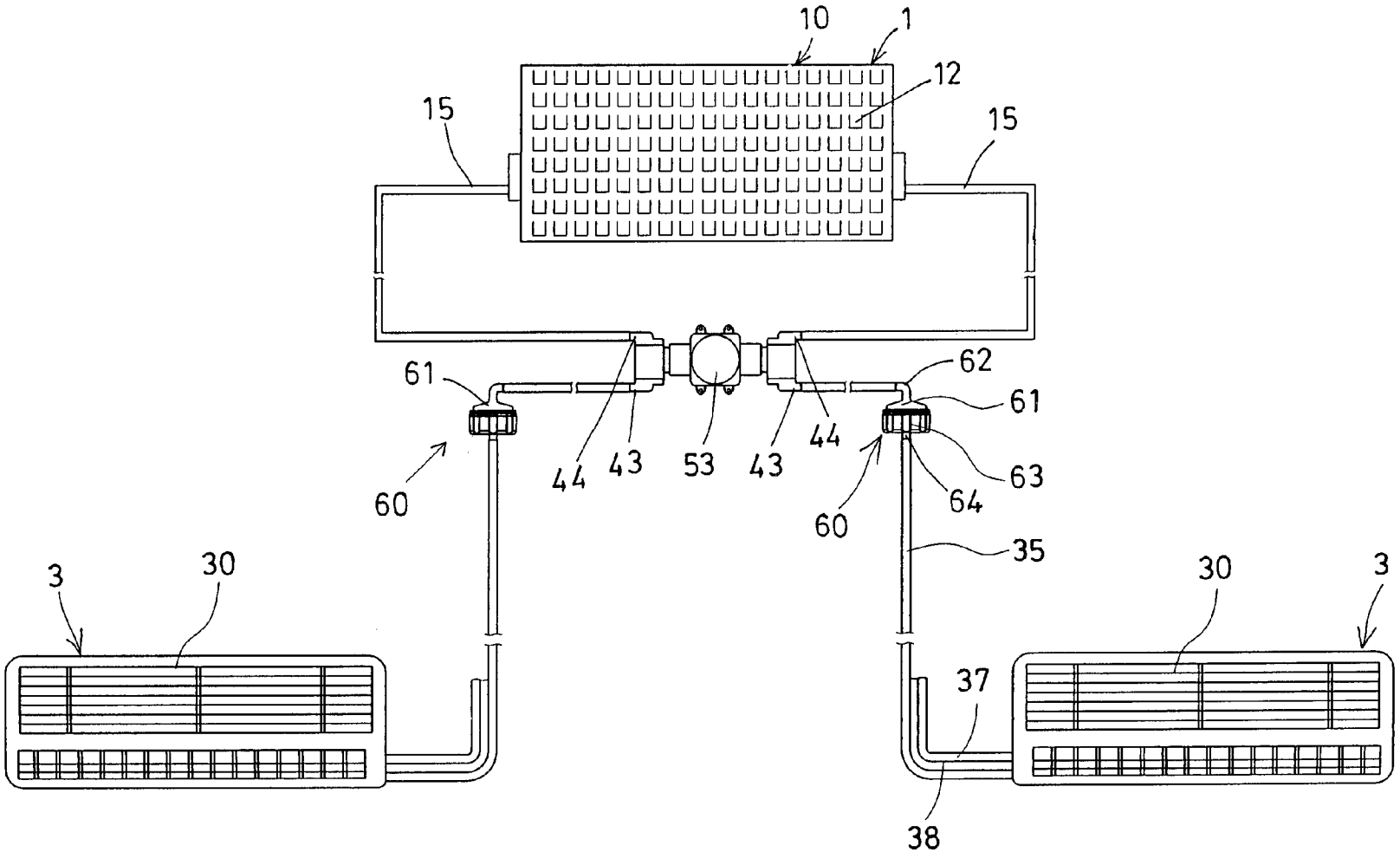
FIG. 15 is a plan schematic view similar to FIG. 12, illustrating the further arrangement of the air conditioner.
Figure 16:
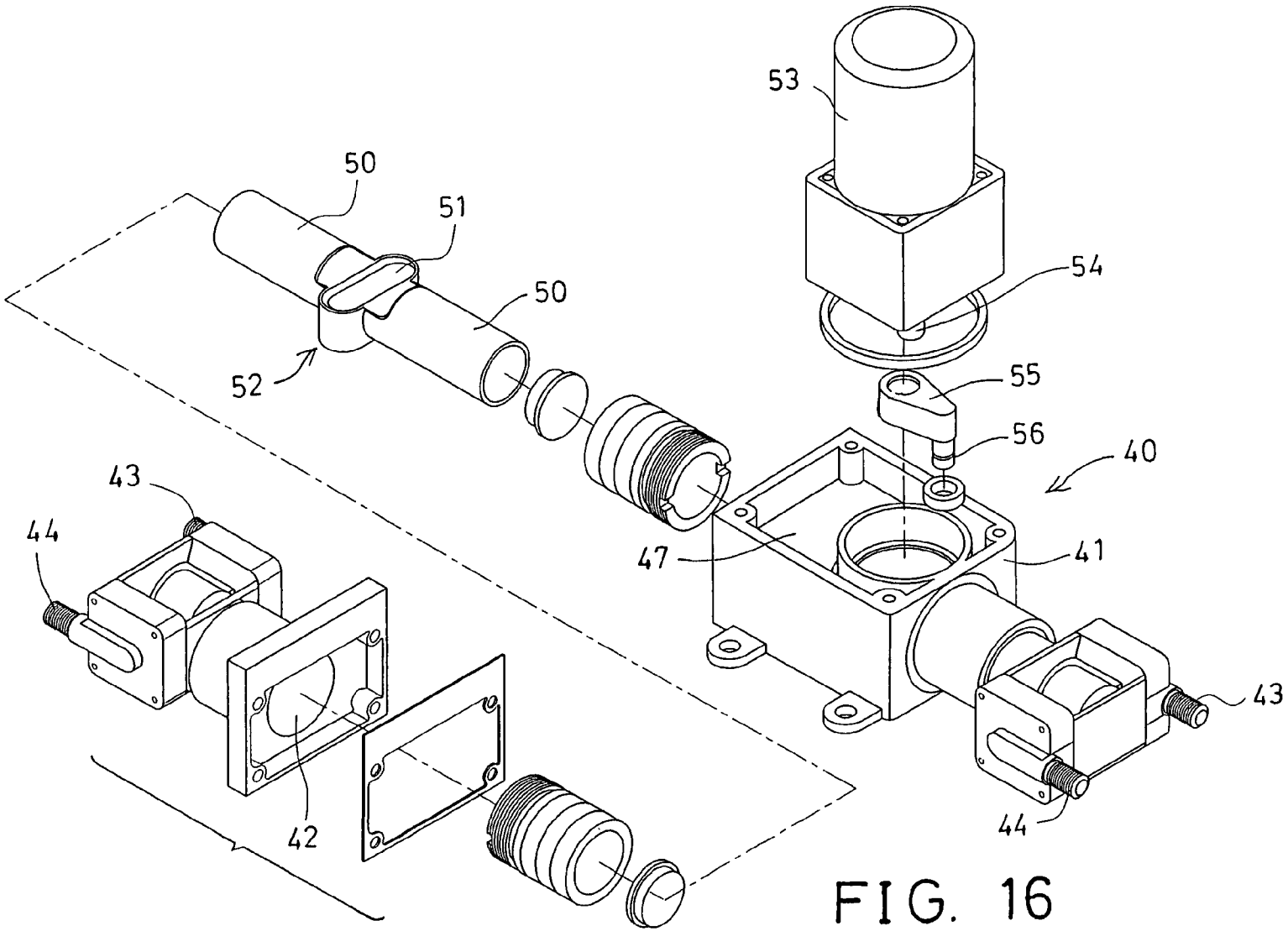
FIG. 16 is an exploded view of a water filtering device for the air conditioner as shown in FIG. 15.
Figure 17:
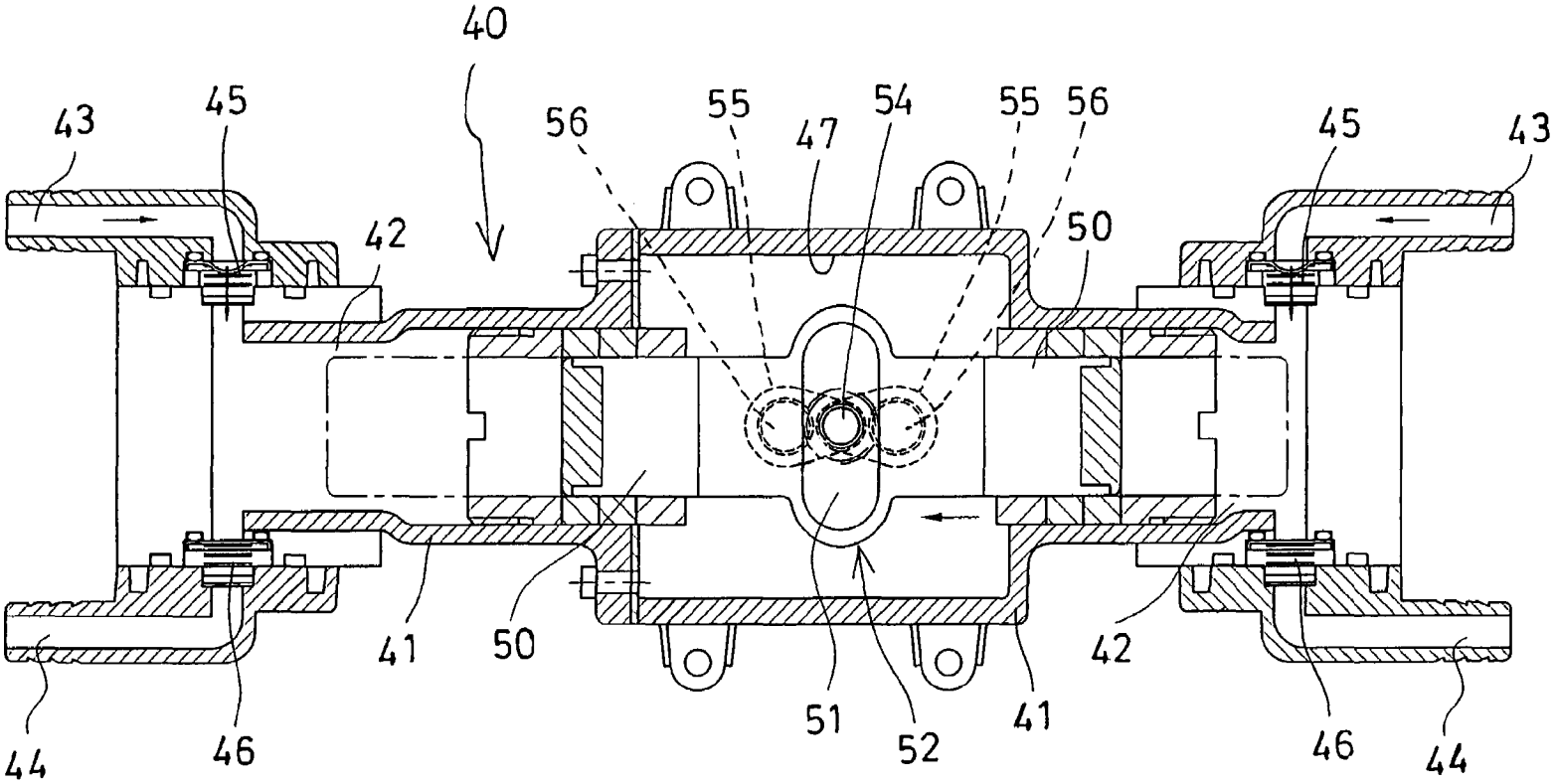
FIG. 17 is a cross sectional view of the water filtering device for the air conditioner as shown in FIGS. 15 and 16.

Referring next to FIGS. 15–17, when two indoor device 3 are provided and coupled to the receptacle 10 of the outdoor device 1, the water draining device 40 may include two pistons 50 slidably received in two channels 42 thereof, to draw or to pump the water from the indoor devices 3 into the receptacle 10 of the outdoor device 1 via the entrances 43 and the exits 44 of the casing 41 respectively.

Figure 10:
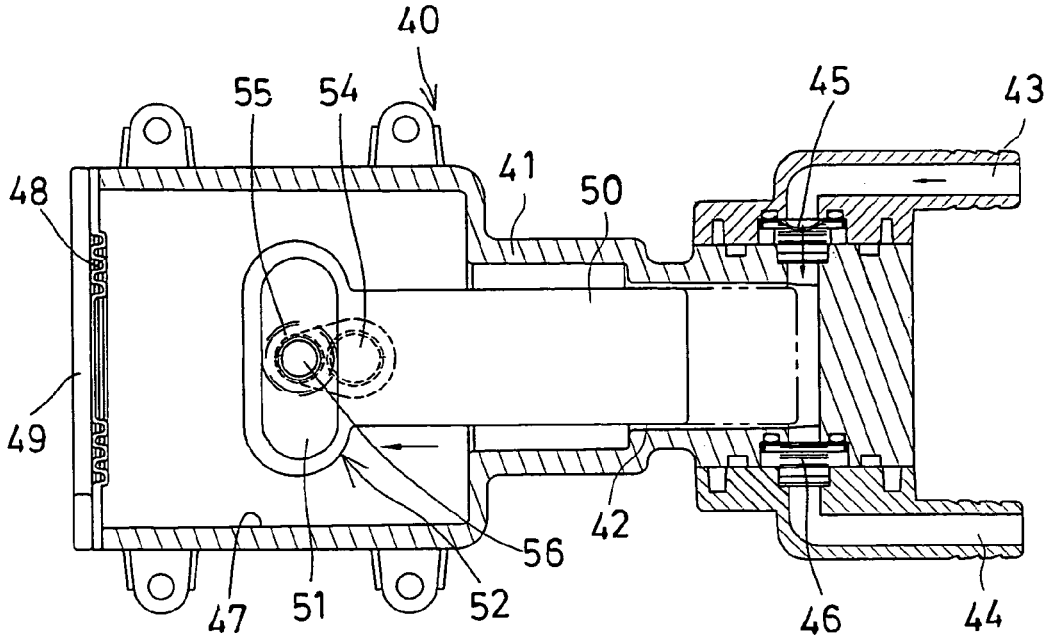
FIG. 10 is a partial cross sectional view taken along lines 10—10 of FIG. 9.
Figure 11:
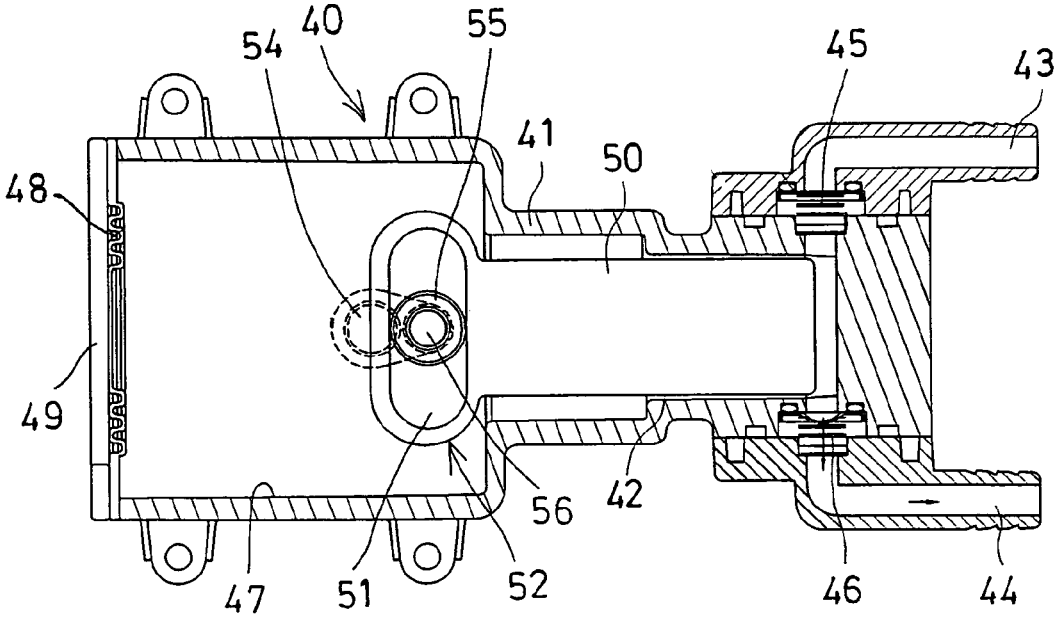
FIG. 11 is a partial cross sectional view similar to FIG. 10, illustrating the operation of the water draining device of the air conditioner.

In operation, as shown in FIGS. 10, 11, when the piston 50 is driven or forced to move or to slide along the channel 42 of the casing 41 in reciprocating action, the sliding movement of the piston 50 may draw or pump the water from the indoor device 3 into the recess 14 of the bottom plate 11 of the receptacle 10 of the outdoor device 1 via the entrance 43 and the exit 44 of the casing 41.

The water contained or received in the recess 14 of the bottom plate 11 of the receptacle 10 of the outdoor device 1 may then be agitated or blown out of the recess 14 of the bottom plate 11, and may be blown toward the heat exchanging device 17 by the fan device 22, to allow the water to be heated or evaporated by the heat exchanging device 17, such that the water that may be generated in the indoor device 3 may be drawn out of the indoor device 3, and may be pumped to the outdoor device 1 by the water draining device 40, to prevent the water from dropping down from the indoor device 3, and from dropping into the family buildings.

As shown in FIG. 1, a timer or a control device 70 may further be provided and/or attached to the indoor device 3, to control the operation of the motor 53, and to prevent the motor 53 from being switched on and switched off frequently by the sensor or controller 36 that is disposed in the tube 34 or the hose 35 (FIG. 7).

Accordingly, the air conditioner in accordance with the present invention includes a draining device for draining or removing water from indoor devices and for preventing water from dropping into family buildings from the indoor devices.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air conditioner comprising:

an indoor device, an outdoor device coupled to said indoor device via a hose, a water draining device coupled between said outdoor device and said indoor device, to force water that may be generated in said indoor device from said indoor device to said outdoor device, and to prevent the water from dropping from said indoor device, and a filter device coupled between said water draining device and said indoor device, said filter device including a base having a mouth coupled to said water draining device, a cap attached onto said base and having another mouth coupled to said indoor device, and a filter member disposed between said base and said cap, to filter the water flowing from said indoor device to said water draining device.

2. An air conditioner comprising:

an indoor device, an outdoor device coupled to said indoor device via a hose, and a water draining device coupled between said outdoor device and said indoor device, to force water that may be generated in said indoor device from said indoor device to said outdoor device, and to prevent the water from dropping from said indoor device, said water draining device including a casing having an entrance and an exit formed therein, and coupled to said indoor device and said outdoor device respectively, and said casing including a channel formed therein and communicating with said entrance and said exit thereof respectively, and a piston slidably received in said channel of said casing, to pump the water from said indoor device to said outdoor device.

3. The air conditioner as claimed in claim 2, wherein said water draining device includes a motor attached to said casing and coupled to said piston, to move said piston along said channel of said casing in reciprocating action.

4. The air conditioner as claimed in claim 3, wherein said water draining device includes a crank coupled to a spindle of said motor, and coupled to said piston, to move said piston along said channel of said casing in reciprocating action.

5. The air conditioner as claimed in claim 4, wherein said piston includes an oblong hole formed therein, said crank includes a pole extended therefrom and slidably received in said oblong hole of said piston, to move said piston to slide along said channel of said casing in reciprocating action.

6. The air conditioner as claimed in claim 2, wherein said indoor device includes a container, and a tray disposed in said container, to collect water, said tray includes an outlet for coupling to said water draining device via a tube.

7. The air conditioner as claimed in claim 6, wherein said indoor device includes a piping disposed in said container, and arranged above said tray, to allow said tray to collect the water from said piping.

8. The air conditioner as claimed in claim 6, wherein said indoor device includes a hose coupled to said tube, and then coupled to said water draining device, and a controller disposed between said tube and said hose, to control the water to flow from said indoor device to said water draining device.

9. An air conditioner comprising:

an indoor device, an outdoor device coupled to said indoor device via a hose, and a water draining device coupled between said outdoor device and said indoor device, to force water that may be generated in said indoor device from said indoor device to said outdoor device, and to prevent the water from dropping from said indoor device, and said outdoor device including a receptacle having a bottom plate, and having an inlet port coupled to said water draining device, to receive the water from said water draining device, and said outdoor device including a fan device disposed in said receptacle, to blow and to dry the water.

10. The air conditioner as claimed in claim 9, wherein said outdoor device includes a compressor and a heat exchanging device disposed in said receptacle and coupled together, and said fan device is directed toward said heat exchanging device, to blow the water toward said heat exchanging device, and to allow the water to be evaporated by said heat exchanging device.

11. The air conditioner as claimed in claim 9, wherein said receptacle includes a recess formed in said bottom plate thereof, to receive and collect the water therein, said recess of said bottom plate is located below said fan device.

12. The air conditioner as claimed in claim 9, wherein said outdoor device includes a motor attached to said receptacle, and having a spindle to which said fan device is attached.

* * * * *